US008351769B2

(12) United States Patent
Kim

(10) Patent No.: US 8,351,769 B2
(45) Date of Patent: Jan. 8, 2013

(54) HEATING APPARATUS, AND STEAM GENERATOR AND HOME APPLIANCE USING THE SAME

(75) Inventor: Kyeong-hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 387 days.

(21) Appl. No.: 12/085,942

(22) PCT Filed: Feb. 6, 2007

(86) PCT No.: PCT/KR2007/000629
§ 371 (c)(1),
(2), (4) Date: Jul. 28, 2010

(87) PCT Pub. No.: WO2008/096915
PCT Pub. Date: Aug. 14, 2008

(65) Prior Publication Data

US 2010/0288743 A1 Nov. 18, 2010

(51) Int. Cl.
*D06F 39/04* (2006.01)

(52) U.S. Cl. ..... 392/324; 219/523; 392/322; 392/386; 392/394

(58) Field of Classification Search ..... 219/523, 219/530; 392/322, 324, 386, 394
See application file for complete search history.

(56) References Cited

U.S. PATENT DOCUMENTS

| | | | | | |
|---|---|---|---|---|---|
| 3,108,531 | A * | 10/1963 | Jepson et al. | 99/331 |
| 4,213,034 | A * | 7/1980 | Goss et al. | 219/535 |
| 4,937,430 | A * | 6/1990 | Belloni | 392/386 |
| 5,203,257 | A * | 4/1993 | Goad | 99/483 |
| 5,381,729 | A * | 1/1995 | Hennessy et al. | 99/483 |
| 5,557,704 | A * | 9/1996 | Dennis et al. | 392/480 |
| 7,917,991 | B2 * | 4/2011 | Chung et al. | 15/321 |
| 2004/0187529 | A1 * | 9/2004 | Kim et al. | 68/207 |
| 2004/0244432 | A1 * | 12/2004 | Kim et al. | 68/5 C |
| 2008/0168805 | A1 * | 7/2008 | Kim et al. | 68/5 C |

FOREIGN PATENT DOCUMENTS

| | | |
|---|---|---|
| DE | 2552625 | 6/1977 |
| DE | 19749958 | 5/1999 |
| EP | 0 275 635 | 7/1988 |
| EP | 0 624 998 | 11/1994 |
| EP | 1 616 990 | 1/2006 |

* cited by examiner

*Primary Examiner* — Allan R Wilson
(74) *Attorney, Agent, or Firm* — McKenna Long & Aldridge LLP

(57) ABSTRACT

A heating apparatus and a steam generator that is capable of heating water to produce hot water or steam and an electric home appliance that is capable of washing, rinsing, drying, or sterilizing an object using the same are disclosed. The heating apparatus and steam generator include a heating member, a fixing unit assembly for fixing the heating member to a predetermined support structure, a thermostat mounted to the fixing unit assembly for preventing the heating member from overheating, and a heat transfer member connected between the heating member and the thermostat for transferring heat from the heating member to the thermostat. The electric home appliance includes the heating apparatus and steam generator.

20 Claims, 9 Drawing Sheets

HEATING APPARATUS, AND STEAM GENERATOR AND HOME APPLIANCE USING THE SAME

This application is a national stage entry of International Application Number PCT/KR2007/000629, filed on Feb. 6, 2007, the contents of which is hereby incorporated herein by reference in its entirety.

TECHNICAL FIELD

The present invention relates to a heating apparatus, and a steam generator and an electric home appliance using the same, and more particularly, to a heating apparatus and a steam generator that is capable of heating water to produce hot water or steam and an electric home appliance that is capable of washing, rinsing, drying, or sterilizing an object using the same.

BACKGROUND ART

A washing machine is a kind of electric home appliance that washes, rinses, and dries laundry using water and detergent. Based on the direction in which laundry is introduced, conventional washing machines are classified into a top-loading type washing machine and a front-loading type washing machine.

The top-loading type washing machine performs washing using a water stream generated by rotating a pulsator in alternating directions and the frictional force generated between laundry articles. Generally, the top-loading type washing machine includes a tub mounted vertically for receiving laundry, a pulsator rotating in the tub for washing the laundry, and a lid mounted at the top of the washing machine for opening and closing the tub.

The front-loading type washing machine performs washing by rotating a drum at low speed while water, detergent, and laundry are put in the drum. Generally, the front-loading type washing machine includes a tub and a drum mounted horizontally for receiving laundry, a plurality of lifters provided at the internal circumferential surface of the drum for lifting the laundry upward and dropping the laundry downward when the drum is rotated, and a door mounted at the front of the washing machine for opening and closing the drum.

Meanwhile, a dish washing machine is another kind of electric home appliance that washes, rinses, and dries dishes using water and detergent. The dish washing machine is constructed in a structure in which injection arms inject wash water collected at the bottom of a tub to the dishes, when a pump is operated, to wash the dishes. Generally, the dish washing machine includes a tub for receiving dishes and wash water, a rack mounted in a tub such that the dishes are placed on the rack, a pump for pumping wash water collected at the bottom of the tub, at least one injection arm for injecting the wash water pumped by the pump to the dishes placed on the rack, and a drainage pump for draining the wash water out of the tub.

The electric home appliances which wash an object using water and detergent, such as the washing machine and the dish washing machine, may adopt a heating apparatus to improve washability. The heating apparatus may be coupled to the tub for heating water stored in the tub. Alternatively, the heating apparatus may be mounted at the middle of a water supply hose for heating water to be supplied into the tub such that hot water or steam can be supplied into the tub.

DISCLOSURE

Technical Problem

During the operation of the heating apparatus, the heating member may overheat. In order to prevent the heating member from overheating, the heating apparatus may include a thermistor or a thermostat. The thermistor or the thermostat is mounted in the tub separately from the heating apparatus for measuring the water temperature in the tub to control the operation of the heating apparatus depending upon the measured water temperature in the tub.

In the above-stated structure, however, the thermistor or the thermostat measures not the temperature of the heating member but the water temperature in the tub. As a result, it is not possible to accurately determine whether the heating member overheats or not. For example, the water temperature in the tub is maintained at approximately 100° C. during the operation of the steam generator, and therefore, it is not possible to determine whether the heating member overheats or not.

In addition, the heating apparatus or the heating member is disposed in the tub and is then fixed to the tub by fasteners, such as bolts and nuts. The thermistor or the thermostat is mounted in the tub separately from the heating apparatus. Consequently, the assembly efficiency and productivity of the electric home appliance decrease.

Furthermore, when the heating apparatus or the heating member and the thermistor and the thermostat are out of order, the remaining parts must be disassembled, and therefore, it is very difficult to carry out a repair process.

Technical Solution

An object of the present invention is to accurately measure the temperature of a heating member, thereby preventing the heating member from overheating.

Another object of the present invention is to improve the assembly efficiency and productivity of a heating apparatus and a steam generator and an electric home appliance using the same and to easily performing a repair process.

The object of the present invention can be achieved by providing a heating apparatus including a heating member, a fixing unit assembly for fixing the heating member to a predetermined support structure, a thermostat mounted to the fixing unit assembly for preventing the heating member from overheating, and a heat transfer member connected between the heating member and the thermostat for transferring heat from the heating member to the thermostat.

Preferably, the heating member, the fixing unit assembly, the thermostat, and the heat transfer member are detachably mounted to the support structure at the same time.

Preferably, the heat transfer member includes a metal layer formed to cover the outer circumferential surface of a heat emission part of the heating member, a portion of the metal layer extending toward the thermostat.

Preferably, the metal layer is formed by die casting, and the metal layer securely fixes the heating member to the fixing unit assembly.

Preferably, the heat transfer member further includes an auxiliary member interposed between the metal layer and the thermostat for indirectly transferring heat from the heat emission part to the thermostat.

In another aspect of the present invention, provided herein is a steam generator including a case having an opening, through which an internal space of the case communicates with the outside, formed in one side thereof, a heating member extending through the opening for generating steam, a fixing unit assembly for fixing the heating member to the case while sealing the opening, a thermostat mounted to the fixing unit assembly for preventing the heating member from overheating, and a heat transfer member for increasing a heat emission area of the heating member and transferring heat from the heating member to the thermostat.

Preferably, the heating member, the fixing unit assembly, the thermostat, and the heat transfer member are detachably mounted to the case at the same time.

Preferably, the fixing unit assembly includes a packing fitted in the opening such that the heating member extends through the packing, and a pressurizing unit for pressurizing the packing to expand the side of the packing such that the heating member is fixed to the case while the opening is sealed.

Preferably, the fixing unit assembly includes an inner bracket and an outer bracket disposed at the inside and the outside of the case, respectively, a packing fitted in the opening, the packing being interposed between the inner bracket and the outer bracket, and fasteners coupled to the inner bracket and the outer bracket such that the fasteners can be tightened or loosened from the outside of the case for changing the distance between the inner bracket and the outer bracket.

Preferably, the heating member and the fixing unit assembly have a size sufficient to be withdrawn out of the case through the opening while the packing is not deformed.

Preferably, the heat transfer member includes a metal layer formed to cover the outer circumferential surface of a heat emission part of the heating member, a portion of the metal layer extending toward the thermostat.

Preferably, the metal layer is formed by die casting, and the metal layer securely fixes the heating member to the fixing unit assembly.

Preferably, the metal layer is directly connected to the thermostat. Alternatively, the heat transfer member may further include an auxiliary member interposed between the metal layer and the thermostat for indirectly transferring heat from the heat emission part to the thermostat.

Preferably, the heat transfer member includes a metal layer formed to cover the outer circumferential surface of a heat emission part of the heating member, and an auxiliary member extending through the inner bracket and the packing for transferring heat from the metal layer to the thermostat.

In another aspect of the present invention, provided herein is an electric home appliance including a tub for storing water, and a heating apparatus connected to the tub for heating the water, wherein the heating apparatus includes a heating member extending through the tub, a fixing unit assembly for fixing the heating member to the tub while sealing the connection between the heating member and the tub, a thermostat mounted to the fixing unit assembly for preventing the heating member from overheating, and a heat transfer member for increasing a heat emission area of the heating member and transferring heat from the heating member to the thermostat.

Preferably, the heating member, the fixing unit assembly, the thermostat, and the heat transfer member are detachably mounted to the tub at the same time.

In a further aspect of the present invention, provided herein is an electric home appliance including a tub for receiving an object, a water supply hose connected between an external water source and the tub, and a heating apparatus mounted at the middle of the water supply hose for heating the water, wherein the heating apparatus includes a case mounted at the middle of the water supply hose, the case having an opening formed in one side thereof, a heating member extending through the opening, a fixing unit assembly for fixing the heating member to the case while sealing the opening, a thermostat mounted to the fixing unit assembly for preventing the heating member from overheating, and a heat transfer member for increasing a heat emission area of the heating member and transferring heat from the heating member to the thermostat.

Preferably, the heating member, the fixing unit assembly, the thermostat, and the heat transfer member are detachably mounted to the case at the same time.

Advantageous Effects

According to the present invention, the heat transfer member accurately measures the temperature of the heating member and transmits the measured temperature of the heating member to the thermostat. Consequently, the present invention has the effect of effectively preventing the heating member from overheating.

Furthermore, the heating apparatus according to the preset invention is characterized in that the heating member and the thermostat are provided as one united body. In addition, it is possible to easily attach to and detach the heating apparatus from the steam generator or the electric home appliance from the outside of the steam generator or the electric home appliance. Consequently, the present invention has the effect of improving the assembly efficiency and productivity of products and accomplish easy repair of the products which are out of order.

DESCRIPTION OF DRAWINGS

The accompanying drawings, which are included to provide a further understanding of the invention, illustrate embodiments of the invention and together with the description serve to explain the principle of the invention.

In the drawings.

BEST MODE

[Mode for Invention]

Figure 1:
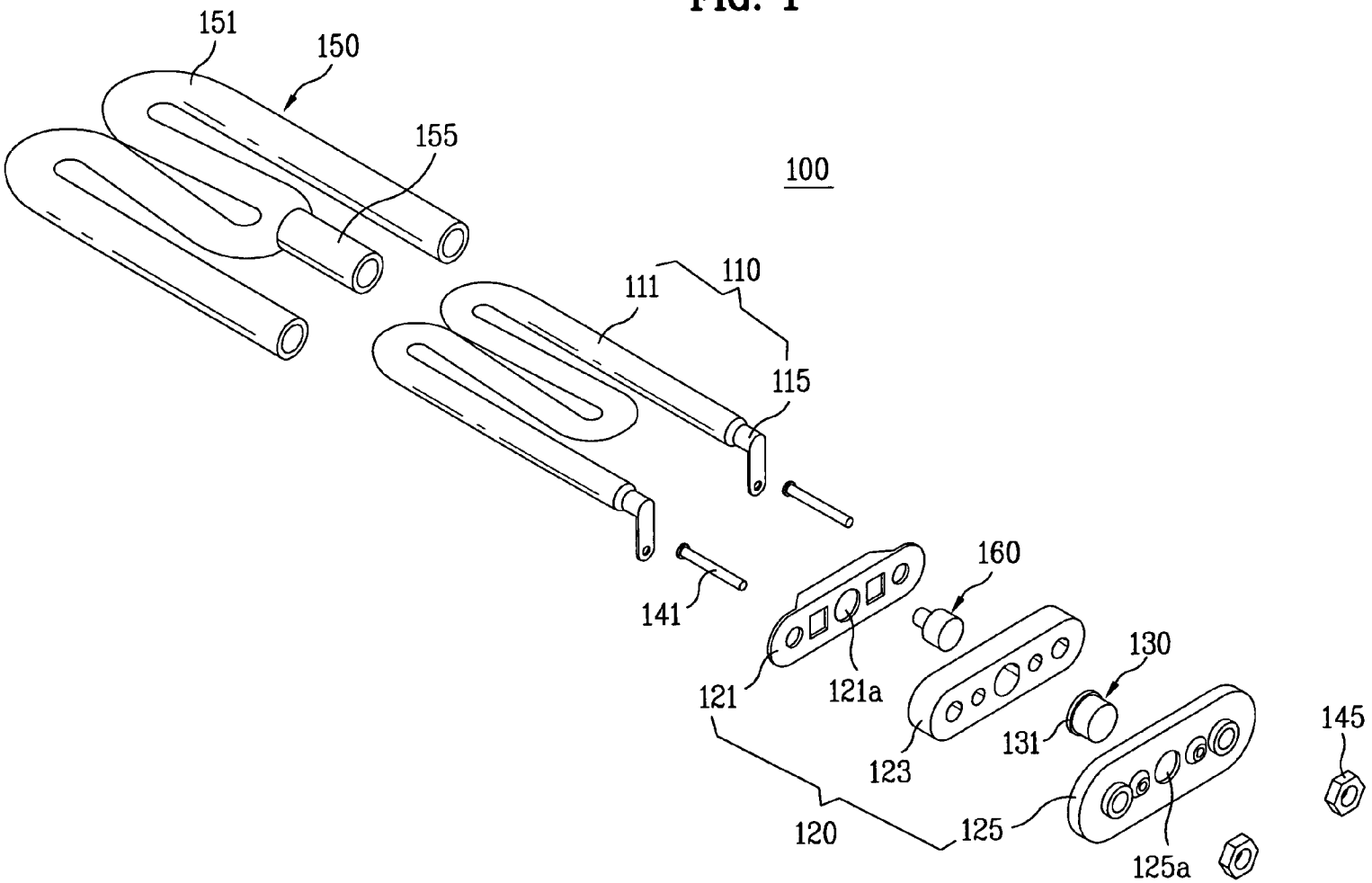
FIG. 1 is an exploded perspective view illustrating an embodiment of heating apparatus according to the present invention.

Reference will now be made in detail to the preferred embodiments of the present invention, examples of which are illustrated in the accompanying drawings. Wherever possible, the same reference numbers will be used throughout the drawings to refer to the same or like parts.

First, FIGS. 1 to 5 illustrate an embodiment of heating apparatus 100 according to the present invention. The heating apparatus 100 includes a heating member 110, a fixing unit assembly 120, a thermostat 130, and a heating transfer member 150.

The heating member 110 includes a heat emission part 111 and terminals 115 formed at opposite ends of the heat generation part 111. The terminals 115 are connected to an external power source. The heat emission part 111 emits heat when the heat emission part 111 is energized through the terminals 115. The heat emission part 111 is bent several times as shown in FIG. 1 to increase the heat emission area of the heat emission part 111.

Figure 2:
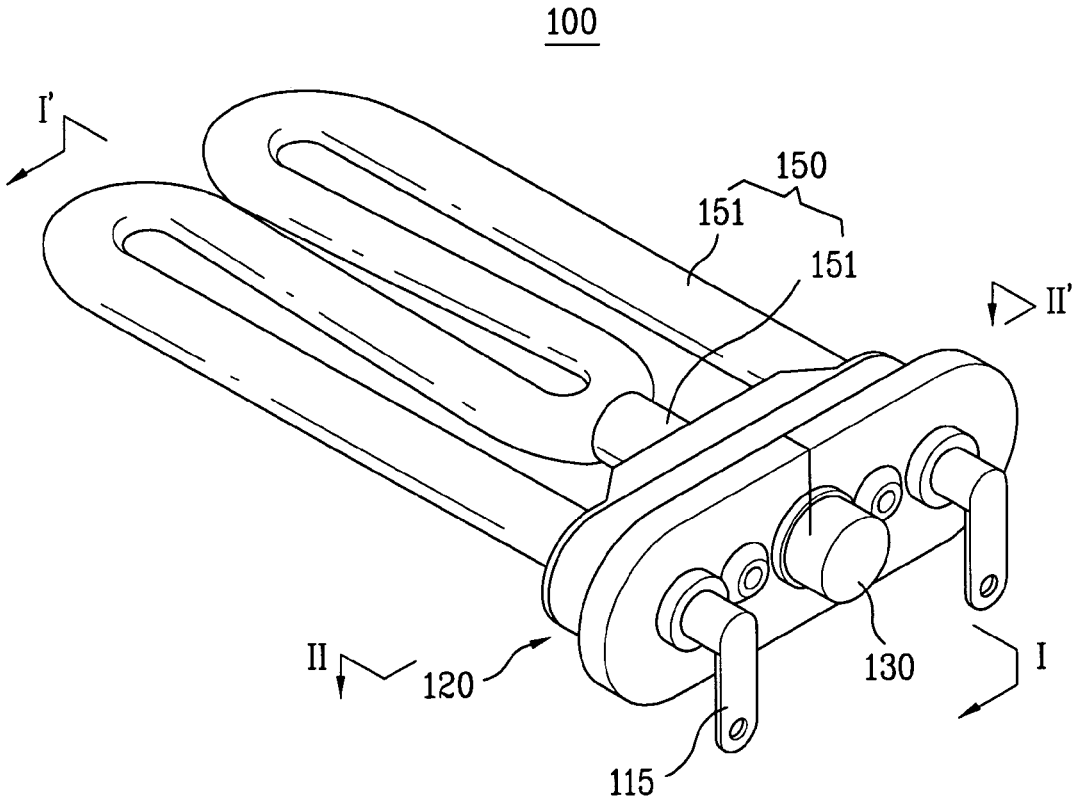
FIG. 2 is an assembled perspective view of the heating apparatus shown in FIG. 1.

The fixing unit assembly 120 serves to fix the heating member 110 to a predetermined supporting structure 190 (see FIGS. 4 and 5), such as a tub or a steam generator of a washing machine or a dish washing machine. As shown in FIG. 2, the fixing unit assembly 120 is coupled to the heating member 110 such that the fixing unit assembly 120 is adjacent to the terminals 115. The heating member 110 extends through the fixing unit assembly 120. The heating member 110 is disposed, for example, such that the terminals 115 are located at the right side and the heat emission part 111 are locates at the left side about the fixing unit assembly 120.

The fixing unit assembly 120 fixes the heating member 110 to the support structure 190, for example, in a manner in which the fixing unit assembly 120 is securely fitted in an opening 191 (see FIGS. 4 and 5) formed in the support structure 190. The fixing unit assembly 120 includes, for example, a packing 123. The packing 123 is fitted in the opening 191 of the support structure 190. The heating member 110 extends through the packing 123. Not only packing 123 fixes the heating member 110 to the support structure 190, but also the packing 123 seals the connection between the heating member 110 and the support structure 190 to prevent the leakage of water. With this basic structure, the heating member 110 may be stably fixed to the predetermined support structure 190, for example, a tub or a steam generator of an electric home appliance.

When the heating member 110 is pulled from the outside of the support structure 190, the packing 123 is disengaged from the opening 191, and therefore, the heating member 110 is separated from the support structure 190 without difficulty. When the packing 123 and the heating member 110 are inserted into the opening 191, the packing 123 is securely fitted in the opening 191 as described above, and therefore, the heating member 110 is easily fixed to the support structure 190. Consequently, the assembly and disassembly of the parts are easily accomplished according to the present invention.

As described above, the heating member 110 may be sufficiently fixed to the support member 190 only with the packing 123. According to the present invention, however, a pressurizing unit is provided for increasing a sealing force of the packing 123 and more stably fixing the heating member 110. The pressurizing unit pressurizes the packing 123 fitted in the opening 191 such that the packing 123 is deformed for effectively preventing the leakage of water through the opening 191. In addition, the pressurizing unit effectively prevents the packing 123 from being disengaged from the opening 191 when the heating member 110 is completely fixed to the support structure 190. Hereinafter, the pressurizing unit will be described in more detail.

The pressurizing unit includes an inner bracket 121 and an outer bracket 125 disposed opposite to each other while the packing is interposed between the inner bracket 121 and the outer bracket 125, and fasteners 140 coupled to the inner bracket 121 and the outer bracket 125 such that the fasteners 140 can be tightened or loosened for changing the distance between the inner bracket 121 and the outer bracket 125 to pressurize or release the packing 123.

The inner bracket 121 is located at the inside of the support structure 190, for example, at the inside of a tub or a steam generator of an electric home appliance. The heating member 110 extends through the inner bracket 121. The inner bracket is in contact with one major surface of the packing 123. The inner bracket 121 may be securely fixed to the heating member 110. The inner bracket 121 has a size substantially equal to or less than that of the opening 191 of the support structure 190. Of course, the packing 123 has a size sufficient to be inserted into the opening 191 while the packing 123 is not deformed due to an external force. Consequently, the assembly of the heating member 110, the inner bracket 121, and the packing 123 can be inserted into the support structure 190 through the opening 191 of the support structure 190, as shown in FIG. 4.

Figure 4:
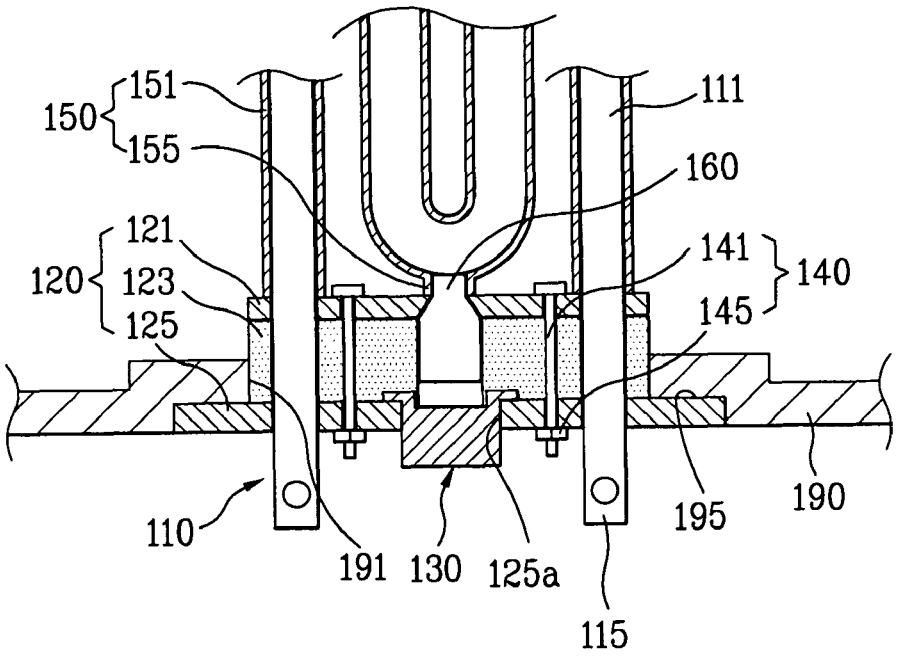
FIG. 4 is a sectional view taken along line II-II' illustrating the heating apparatus shown in FIG. 2 before a packing is pressurized.

As shown in FIG. 4, the outer bracket 125 is located at the outside of the support structure 190 such that the outer bracket 125 is in contact with the packing 123. The outer bracket 125 has a size greater than, for example, that of the opening 191. The outer bracket 125 covers the opening 191 at the outside of the support structure 190. The edge of the outer bracket 125 is supported by the outer surface of the support structure 190. Consequently, after the heating member 110 is completely fixed to the support structure 190, the heating member 110 is prevented from being inserted into the supporting body 190 although an external force may be applied to the heating member 110.

The heating member 110 extends though the outer bracket 125. The inner bracket 121 is fixed to the heating member 110, whereas the outer bracket 125 is slidably fitted on the heating member 110. Alternatively, the outer bracket 125 may be fixed to the heating member 110, and the inner bracket 121 may be slidably coupled to the heating member 110.

Figure 5:
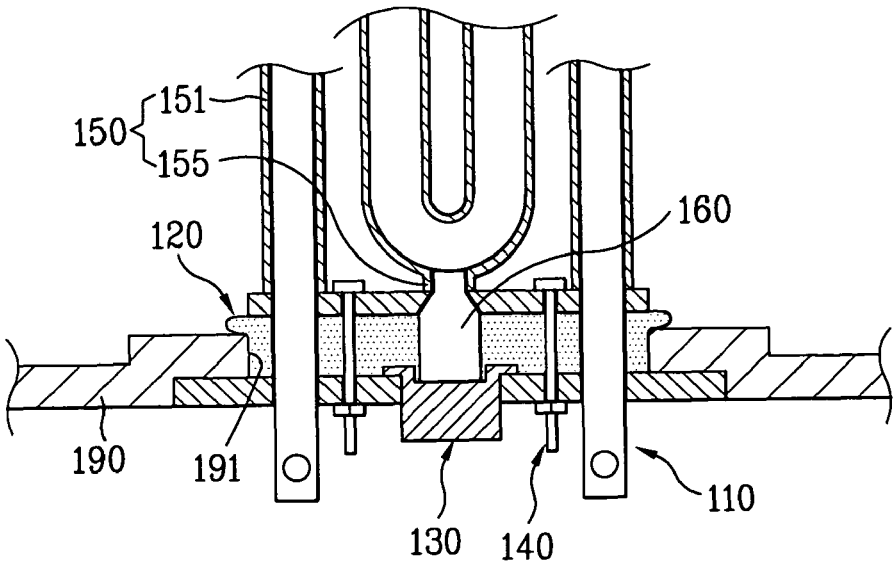
FIG. 5 is a sectional view taken along line II-II' illustrating the heating apparatus shown in FIG. 2 before the packing is pressurized.

As shown in FIGS. 4 and 5, the support structure 190 is provided at the outer surface thereof with a groove 195 for receiving the edge of the outer bracket 125. Consequently, when the heating member 110 is fixed to the support structure 190, the outer surface of the outer bracket 125 does not protrude from the outer surface of the support structure 190.

The fasteners 140 can be fastened or loosened from the outside of the support structure 190. Each fastener 140 includes, for example, a bolt 141 and a nut 145. As shown in FIGS. 4 and 5, the bolt 141 extends through the inner bracket 121, the packing 123, and the outer bracket 125. The nut 145 is coupled with the bolt 141 at the outside of the support structure 190. Alternatively, the nut 145 may be located at the inside of the support structure 190, and a head part of the bolt 141 may be located at the outside of the support structure 190.

Referring to FIG. 1, the bolts 141 are provided separately from the inner bracket 121 or the outer bracket 125, and the bolts 141 extend through the inner bracket 121, the packing 123, and the outer bracket 125. Alternatively, the bolts may be integrally formed with the inner bracket 121 or the outer bracket 125. On the other hand, the nuts 145 are provided as individual elements as shown in FIG. 1. Alternatively, a thread part formed in the inner bracket 121 or the outer bracket 125 may be substituted for the nuts 145.

When a user fastens the nuts 145 or the head parts of the bolts 141 exposed to the outside of the support structure 190 while the heating member 100 assembled as shown in FIG. 4 is fitted in the opening 191 of the support structure 190, the distance between the inner bracket 121 and the outer bracket 125 gradually decreases, and therefore, the packing 123 is pressurized with the result that the packing 123 is deformed.

At this time, the opposite major surfaces of the packing 123, i.e., the front surface and the rear surface of the packing 123, are supported by the inner bracket 121 and the outer bracket 125, respectively, with the result that the front surface and the rear surface of the packing 123 are not deformed, and only the side surfaces and the upper and lower surfaces of the packing 123, which are not supported by the inner bracket 121 and the outer bracket 125, are expanded. The edge of the packing 123 pressurized and expanded in the lateral direction and the vertical direction as described above is caught by the inner surface of the support structure 190. As a result, the heating member 110 is prevented from being separated from the support structure 190 through the opening 191.

When the user loosens the nuts 145 or the head parts of the bolts 141 in the state shown in FIG. 5, on the other hand, the distance between the inner bracket 121 and the outer bracket 125 gradually increases with the result that the packing 123 returns to its original states as shown in FIG. 4. When the user pulls the heating member 110 toward the outside of the support structure 190 in this state, the packing 123 and the inner bracket 121 are disengaged from the support structure 190 through the opening 191, and therefore, the heating member 110 is separated from the support structure 190.

When the fastener 140 is fastened as described above, the heating apparatus 100 according to the present invention is stably fixed to the support structure 190. When the fastener 140 is loosened, on the other hand, the heating apparatus 100 is easily separated from the support structure 190 from the outside of the support structure 190. Consequently, when the heating apparatus 100 is out of order or the heating member 110 is to be replaced, it is possible to easily repair the heating apparatus 100 or easily replace the heating apparatus 100 with a new one without the disassembly of other parts of an electric home appliance. In addition, the heating apparatus 100 can be easily fixed to other parts of the electric home appliance, and therefore, the assembly efficiency and productivity of the electric home appliance are improved.

Meanwhile, the thermostat 130 is mounted to the fixing unit assembly 120. For example, as shown in FIG. 1, the thermostat 130 extends through the outer bracket 125. To this end, the outer bracket 125 is provided in the center thereof with a hole 125*a*, through which the thermostat 130 extends. As shown in FIG. 1, the thermostat 130 is provided at one side thereof with a flange 131. When the thermostat 130 extends through the hole 125*a* of the outer bracket 125, the flange 131 of the thermostat 130 is interposed between the packing 123 and the outer bracket 125. The flange 131 has a diameter greater than that of the hole 125*a* of the outer bracket 125 with the result that the thermostat 130 is prevented from passing through the hole 125*a*. When the fixing unit assembly 120 is assembled, the thermostat 130 is stably fixed by the outer bracket 125 and the packing 123.

Although not shown, the thermostat 130 is electrically connected to the terminals 115 of the heating member 110. The thermostat 130 is a kind of actuator that is operated when heat is applied to the thermostat 130. When the thermostat 130 is heated to a predetermined temperature level, the thermostat 130 interrupts electric current supplied to the terminals 115. The thermostat 130 is a part that is being widely used at the present time, and a detailed description of the thermostat 130 will not be given. In the heating apparatus 100 according to the present invention, the thermostat 130 is operated, when heat from the heating member 110 is transferred to the thermostat 130, to prevent the heating member 110 from overheating.

The thermostat 130 is mechanically operated when heat is applied to the thermostat 130. Consequently, it is not necessary to electronically control the operation of the thermostat 130 using a control unit. In the heating apparatus 100 according to the present invention, however, a temperature sensor for measuring the temperature of the heating member 110, such as a thermistor, may be substituted for the thermostat 130. In this case, the temperature sensor may be connected to the control unit such that a signal related to the temperature of the heating apparatus 100 can be transmitted to the control unit, and a switch controllable by the control unit may be connected to the terminals of the heating member 110. Consequently, the temperature sensor, the control unit, and the switch may be operated according to the temperature of the heating member 110 to prevent the heating member 110 from overheating as in the same manner as the thermostat 130.

The heat transfer member 150 connects the heating member 110 and the thermostat 130 or the temperature sensor such that the heat from the heating member 110 can be effectively transferred to the thermostat 130 or the temperature sensor. The heat transfer member 150 directly transfers heat from the heating member 110, more specifically the heat emission part 111, to the thermostat 130 through a thermal conduction phenomenon. The heat transfer member 150 is made of a metal material having high heat transfer efficiency, for example, aluminum. The heat transfer member 150 extends through the fixing unit assembly 120 such that a portion of the heating member 110, i.e., the heat emission part 111, is connected to the thermostat 130.

Not only the heat transfer member 150 transfers heat from the heating member 110, more specifically the heat emission part 111, to the thermostat 130, but also the heat transfer member 150 increases the heat emission area of the heat emission part 111. In this case, the heat transfer member 150 may include a metal layer 151 formed to cover the outer circumferential surface of the heat emission part 111 of the heating member 110 as shown in FIG. 1.

The metal layer 151 is made of a metal material having high thermal conductivity, for example, aluminum. The metal layer 151 is integrally formed with the heat emission part 111 of the heating member 110 by die casting. When the inner bracket 121 is to be fixed to the heating member 110, the metal layer 151 is formed by die casting such that the heat emission part 111 and the inner bracket 121 are substantially integrated. The metal layer 151 covers the outer circumferential surface of the heat emission part 111 of the heating member 110 to substantially increase the surface area of the heat emission part 111. Consequently, the heating efficiency of the heating apparatus according to the present invention is improved.

Figure 7:
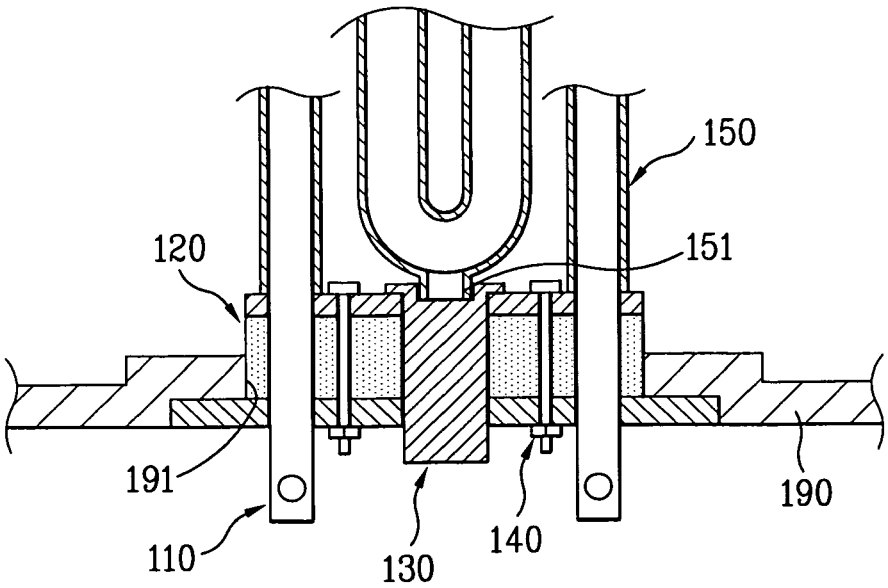

As shown in FIGS. 1, 2, 4 and 5, a portion of the metal layer 151 may extend toward the thermostat 130. More specifically, the middle part of the heating member 110 is bent such that the middle part of the heating member 110 protrudes toward the fixing unit assembly 120. An extension extends from the metal layer covering the middle part of the heating member 110 toward the thermostat 130. The extension 155 may extend shorter only to the inner bracket 121 as shown in FIGS. 4, 5, and 7. On the other hand, the extension 155 may extend longer such that the extension 155 extends through the inner bracket 121 and the packing 123.

When the extension 155 extends shorter only to the inner bracket 121, the heat transfer member 150 may further include an auxiliary member 160 as shown in FIGS. 1, 4, and 5. The auxiliary member 160 is made of a metal material having high thermal conductivity, for example, the same material as the metal layer 151. The auxiliary member 160 is interposed between the metal layer 151 and the thermostat 130 for indirectly transferring heat from the heat emission part 111 to the thermostat 130.

The auxiliary member 160 is formed, for example, in the shape of a long cylinder. The auxiliary member 160 extends through the inner bracket 121 and the packing 123. As shown in FIGS. 4 and 5, one end of the auxiliary member 160 extends through the inner bracket 121 and is then connected to the extension 155 of the metal layer 151. The other end of the auxiliary member 160 extends through the packing 123 and is then connected the thermostat 130. The auxiliary member 160 has a length sufficient to connect the extension 155 of the metal layer 151 and the thermostat 130 with each other when the fastener 140 is sufficiently fastened, i.e., the packing 123 is sufficiently pressurized, as shown in FIG. 5.

The auxiliary member 160 receives heat from the heat emission part 111 through the one end thereof connected to the extension 155 of the metal layer 151 and transfers the heat to the thermostat 130 through the other end thereof. Consequently, the thermostat 130 effectively receives heat from the heat emission part 111 through the metal layer 151 and the auxiliary member 160, whereby the thermostat 130 is accurately operated according to the temperature of the heat emission part 111.

When the extension 155 extends shorter only to the inner bracket 121, the thermostat 130 may be arranged as shown in FIG. 7 such that the thermostat 130 extends through the packing 123 and the inner bracket 121 and is then connected to the extension 155, as another example. In this case, the thermostat 130 effectively receives heat from the heat emission part 111 through the extension 155 of the metal layer 151, whereby the thermostat 130 accurately measures the temperature of the heat emission part 111 and is accurately operated according to the temperature of the heat emission part 111.

When the extension 155 extends shorter only to the inner bracket 121, the thermostat 130 may receive heat from the heat emission member 110 through the inner bracket 121, as a further example. To this end, the thermostat 130 at least extends through the packing 123 and is then connected to the inner bracket 121 to receive heat from the heat emission part 111. The opposite ends of the heat emission part 111 adjacent to the terminals 115 and the extension 155 of the metal layer 151 are integrally connected to the inner bracket 121 by die casting. As a result, heat from the heat emission part 111 is effectively transferred to the inner bracket 121, and heat from the inner bracket 121 is effectively transferred to the thermostat 130. In this case, therefore, the thermostat 130 is accurately operated according to the heat emitted from the heat emission part 111.

Figure 6:
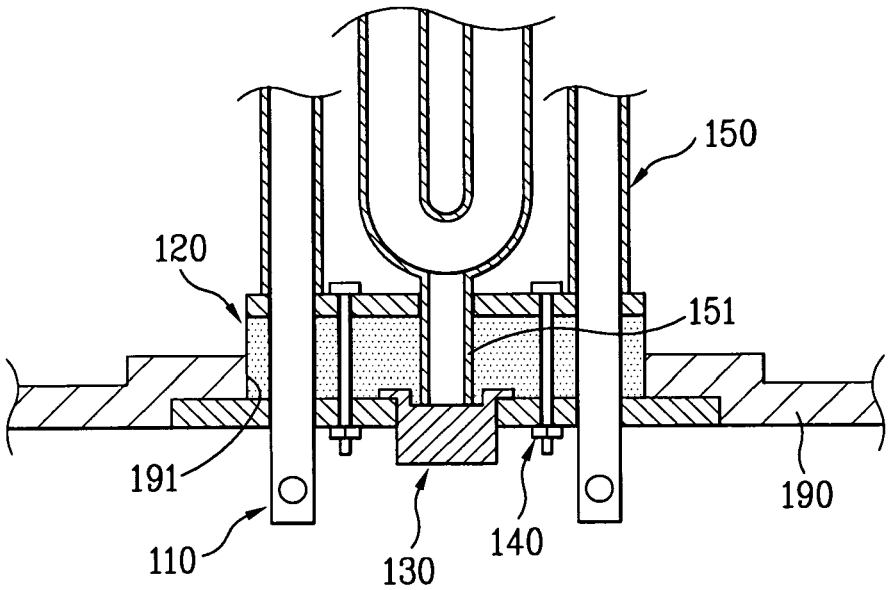
FIGS. 6 and 7 are sectional views, in part, illustrating another embodiment of heating apparatus according to the present invention.

On the other hand, when the extension 155 of the metal layer 151 extends longer as shown in FIG. 6, the extension 155 are arranged such that the extension 155 extends through the inner bracket 121 and the packing 123 and is then directly connected to the thermostat 130. Consequently, the thermostat 130 sufficiently receives heat from the heat emission part 111 through the extension 155, and therefore, the thermostat 130 is accurately operated according to the received heat.

Meanwhile, the mass productivity of products is higher when the extension 155 extends shorter as shown in FIGS. 4 and 5 than when the extension 155 extends longer as shown in FIG. 6.

More specifically, when the extension 155 extends only to the inner bracket 121, it is possible to form the metal layer 151 at the outer surface of the heat emission part 111 by die casting while all the parts excluding the metal layer 151 are assembled. Consequently, the assembly process is performed at one site, and the assembled heating apparatus 100 is transferred to another site where the die casting process is performed to complete the heating apparatus 100 according to the present invention.

When the extension 155 extends longer, however, it is not possible to perform the die casting while the heating apparatus 100 is assembled. In this case, therefore, the heating member 119 and the inner bracket are assembled at one site, the assembled parts are transferred to another site where the die casting is performed, and then the die cast parts are transferred to their initial site where remaining parts are assembled to the die cast parts, which is very troublesome. When the extension 155 extends longer, however, it is possible to decrease the number of parts of the heating apparatus 100.

Although not shown in FIG. 7, on the other hand, when the extension 155 extends to the inner bracket 121, and the thermostat 130 is connected to the inner bracket 121, it is necessary for the thermostat 130 to have a length sufficient to extend through the fixing unit assembly 120. For this reason, it is difficult to use thermostat 130 having a normal size manufactured according to standard requirements. In this case, however, it is possible to reduce the number of parts and simplify the assembly process.

Hereinafter, the assembly and production of the heating apparatus 100 according to the present invention will be described in brief. The following description will be made based on an example in which the heating apparatus 100 is provided with the auxiliary member 160. The assembly and production of the heating apparatus 100 described below is an exemplary embodiment of the present invention, and therefore, it should be noted that the heating apparatus 100 according to the preset invention is not assembled and produced only through the following process.

First, as shown in FIG. 1, the nuts 145, the outer bracket 125, the thermostat 130, the packing 123, the auxiliary member 160, the inner bracket 121, the bolts 141, and the heating member 110 are prepared. The bolts 141 are inserted through the inner bracket 121, and one end of the auxiliary member 160 is fitted into the inner bracket 121. After that, the inner bracket 121 is fitted onto the heating member 110. At this time, the inner bracket 121 may be securely fixed to the heating member 110, for example, by welding. However, the inner bracket 121 may be assembled to the heating member 110 in a different fashion, or the heating member 110 is may be simply fitted into the inner bracket 121.

After the heating member 110, the inner bracket 121, and the bolts 141 are assembled, the packing 123 is fitted onto the heating member 110 such that the packing 123 is brought into tight contact with the inner bracket 121. After that, the thermostat 130 is fitted into the outer bracket 124. The outer bracket 125 having the thermostat 1309 attached thereto is fitted onto the heating member 110. Subsequently, the nuts 145 are coupled to the corresponding bolts 141 to complete the assembly of the respective parts. At this time, the nuts 145 are fastened to such an extent that the packing 123 is not pressurized.

Figure 3:
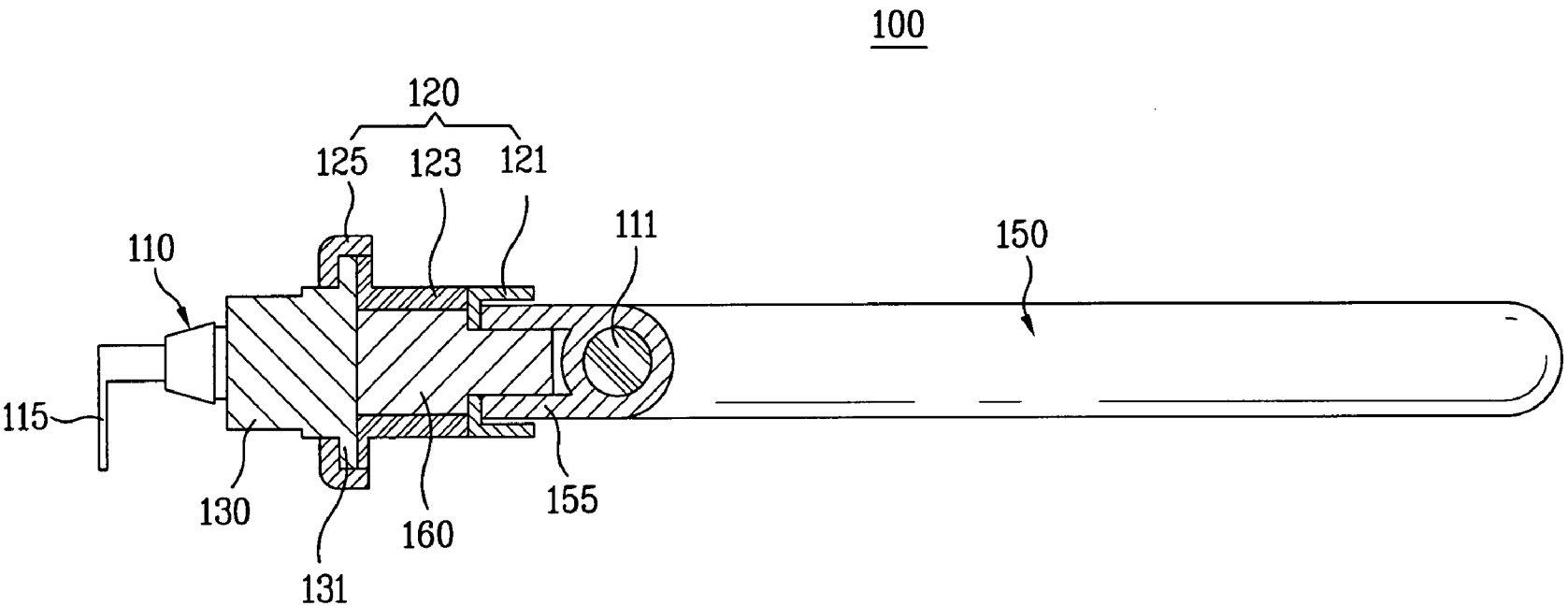
FIG. 3 is a sectional view taken along line I-I' of the heating apparatus shown in FIG. 2.

After the assembly of the heating member is completed, the heat emission part ill of the assembled heating member 110 is placed in a mold into which metal, such as aluminum, is injected to perform die casting. At this time, the aluminum is brought into tight contact with the surface of the inner bracket 121 as well as the outer surface of the heat emission part 111. Consequently, the heat emission part 111, the metal layer 151, the inner bracket 121 substantially form a single body. After the die casting is performed, the mold is removed with the result that the heating apparatus 100 having the metal layer 151 formed at the outer surface of the heat emission part 111 is completed as shown in FIGS. 2 and 3.

Figure 8:
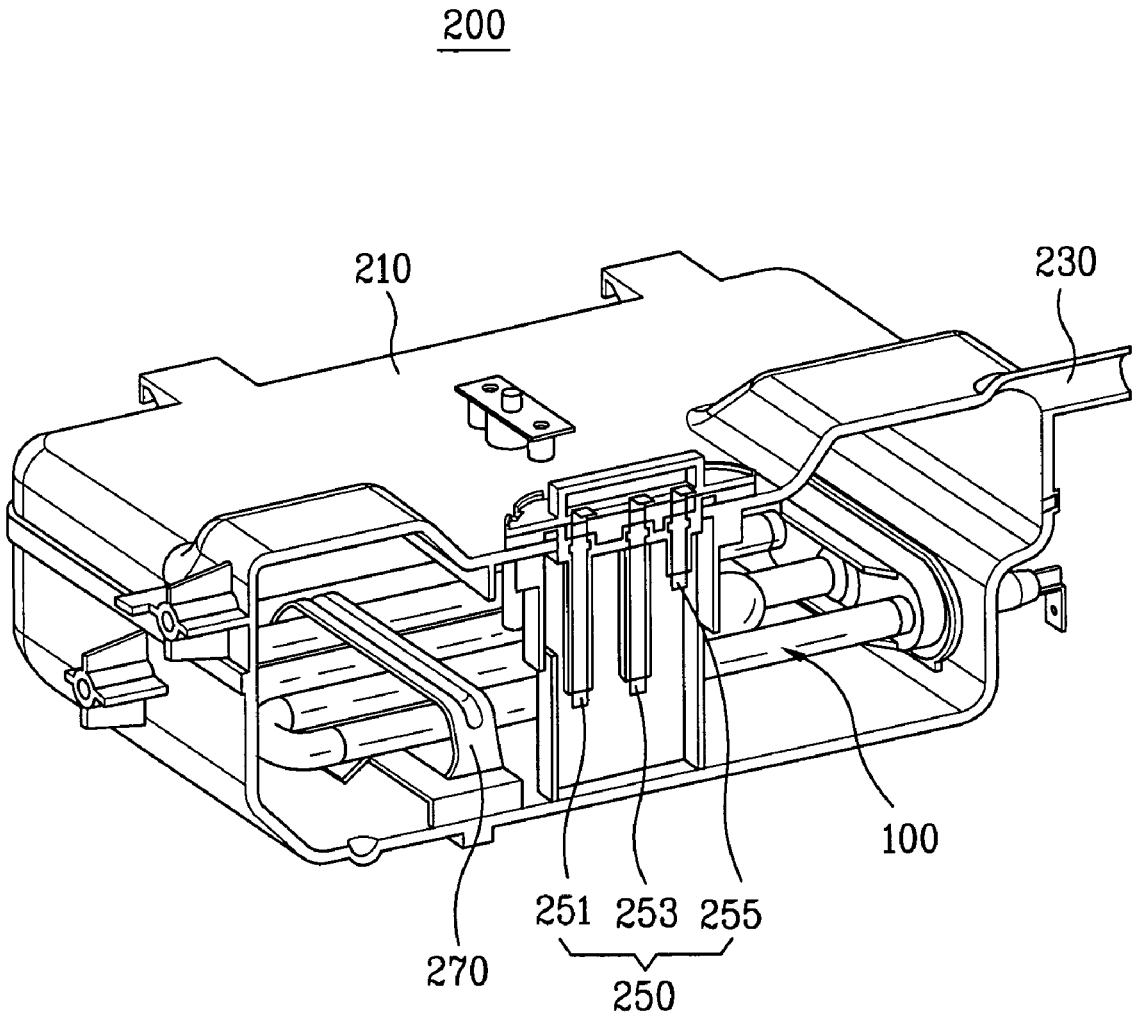
FIG. 8 is perspective view illustrating the internal structure of a steam generator to which the heating apparatus shown in FIG. 1 is applied.

The heating apparatus 100 with the above-stated construction according to the preset invention may be used to heat a fluid, such as water, stored in the support structure 190. Alternatively, the heating apparatus 100 according to the present invention may be applied to a steam generator that heats a fluid, such as water, stored in the support structure 190 to generate steam and supplies the steam to a different apparatus. FIG. 8 is perspective view illustrating an embodiment of steam generator 200 to which the heating apparatus 100 according to the present invention is applied. Hereinafter, the structure of the steam generator 200 according to the present invention will be described with reference to FIG. 8.

The steam generator 200 includes a case 210 having an inlet port, an outlet port 230, and an opening, a heating apparatus 100 mounted at the inner bottom of the case 210, and a water level sensor assembly 250 for detecting the water level in the case 210.

The case 210 has a space defined therein for receiving a predetermined amount of water. The inlet port and the outlet port 230 are formed approximately in the upper part of the case 210 such that the water is prevented from leaking out of the case 210 through the inlet port, and steam generated in the case 210 is easily discharged through the outlet port 230.

As shown in FIG. 8, the heating apparatus 100 is fitted in the inside of the case 210 from the outside of the case 210 through the opening of the case 210. The structure of the heating apparatus and the process of mounting the heating apparatus were described above in detail, and therefore, detailed descriptions thereof will not be given. Meanwhile, one end of the heat emission part 111 is supported by a clamp 270 provided at the bottom of the case 210 such that the one end of the heat emission part 111 is spaced a predetermined distance from the bottom of the case 210.

The water level sensor assembly 250 includes a plurality of electrodes for detecting the minimum water level and the full water level in the case 210. Here, the minimum water level is a water level to prevent the heat emission part 111 of the heating member 110 from overheating. The minimum water level is set to be slightly higher than the upper end of the heat emission part 111 such that the heat emission part 111 is prevented from being exposed. On the other hand, the full water level is a water level to prevent the water introduced into the case 210 from overflowing through the outlet port 230. The full water level is set to be slightly lower than the outlet port 230.

The water level sensor assembly 250 for detecting the minimum water level and the full water level includes a common electrode 251, a first electrode 253, and a second electrode 255, for example, as shown in FIG. 8. The common electrode 251, the first electrode 253, and the second electrode 255 are vertically disposed at predetermined intervals. The upper ends of the common electrode 251, the first electrode 253, and the second electrode 255 extend through the top of the case 210. Terminals are formed at the upper ends of the respective electrodes which extend through the case 210 to be exposed to the outside, respectively.

The common electrode 251 and the first electrode 253 extend a predetermined length as shown in FIG. 8. The common electrode 251 and the first electrode 253 have the same lower end height. Consequently, the common electrode 251 and the first electrode 253 are submerged in water or exposed from the water at the same time. When the common electrode 251 and the first electrode 253 are submerged in water at the same time, the common electrode 251 and the first electrode 253 are electrically connected with each other. Accordingly, the control unit (not shown) determines that the water level in the case 210 is higher than the minimum water level.

On the other hand, when the water level in the case 210 decreases, and therefore, both the common electrode 251 and the first electrode 253 are exposed from the water, the common electrode 251 and the first electrode 253 are electrically disconnected from each other. Accordingly, the control unit determines that the water level in the case 210 is lower than the minimum water level. When the water level in the case 210 is lower than the minimum water level, the control unit supplies water into the case 210 through the inlet port.

The second electrode 255 has a length smaller than that of the common electrode 251 and the first electrode 253. As a result, the lower end of the second electrode 255 is higher than the lower ends of the common electrode 251 and the first electrode 253. When the water level in the case 210 is low, and therefore, the second electrode 255 is not submerged in water, the common electrode 251 and the second electrode 255 are maintained to be electrically disconnected from each other. Accordingly, the control unit determines that the water level in the case 210 does not reach the full water level.

On the other hand, when the water level in the case 210 increases, and therefore, the second electrode 255 is submerged in water, the common electrode 251, the first electrode 253, and the second electrode 255 are all electrically connected with one another. Accordingly, the control unit determines that the water level in the case 210 is the full water level. When the water level in the case 210 is the full water level, the control unit stops the supply of water into the case 210.

Hereinafter, a process of generating steam using the steam generator 200 with the above-stated construction will be described in brief. First, the control unit measures the water level in the case 610 using the water level sensor assembly 250. When the water level in the case 610 is lower than the full water level, the control unit supplies water into the case 210. When the full water level is detected by the water level sensor assembly 250, on the other hand, the control unit stops the supply of water into the case 210.

When the case 210 is filled with the water, the heating apparatus 100 is operated to heat the water in the case 210. As the water is heated, steam is generated. The generated steam is discharged through the outlet port at high pressure. As the steam is continuously discharged from the case 210, the water level in the case 210 gradually decreases. When the water level in the case 210 reaches the minimum water level, the heat emission unit 111 is exposed from the water, and therefore, the temperature of the heat emission part 111 rapidly increases. The high temperature of the heat emission part 111 is transferred to the thermostat 130 through the heat transfer member 150 and the auxiliary member 160. As a result, the thermostat 130 interrupts the supply of electric current to the heating member 110, and therefore, the heat emission part 111 is prevented from overheating. Also, the control unit supplies water into the case 210.

Meanwhile, the steam generator 200 shown in FIG. 8 is not limited to generate steam. For example, the steam generator 200 may be constructed to heat water and supply the heated water to another apparatus. Specifically, the heating apparatus 100 and the steam generator 200 with the above-stated construction according to the present invention may be applied to electric home appliances that wash, rinse, dry, and sterilize an object using hot water or steam. Representative electric home appliances include a washing machine and a dish washing machine. Hereinafter, a brief description will be made of electric home appliances to which the heating apparatus 100 and the steam generator 200 according to the present invention are applied with reference to the drawings.

Figure 9:
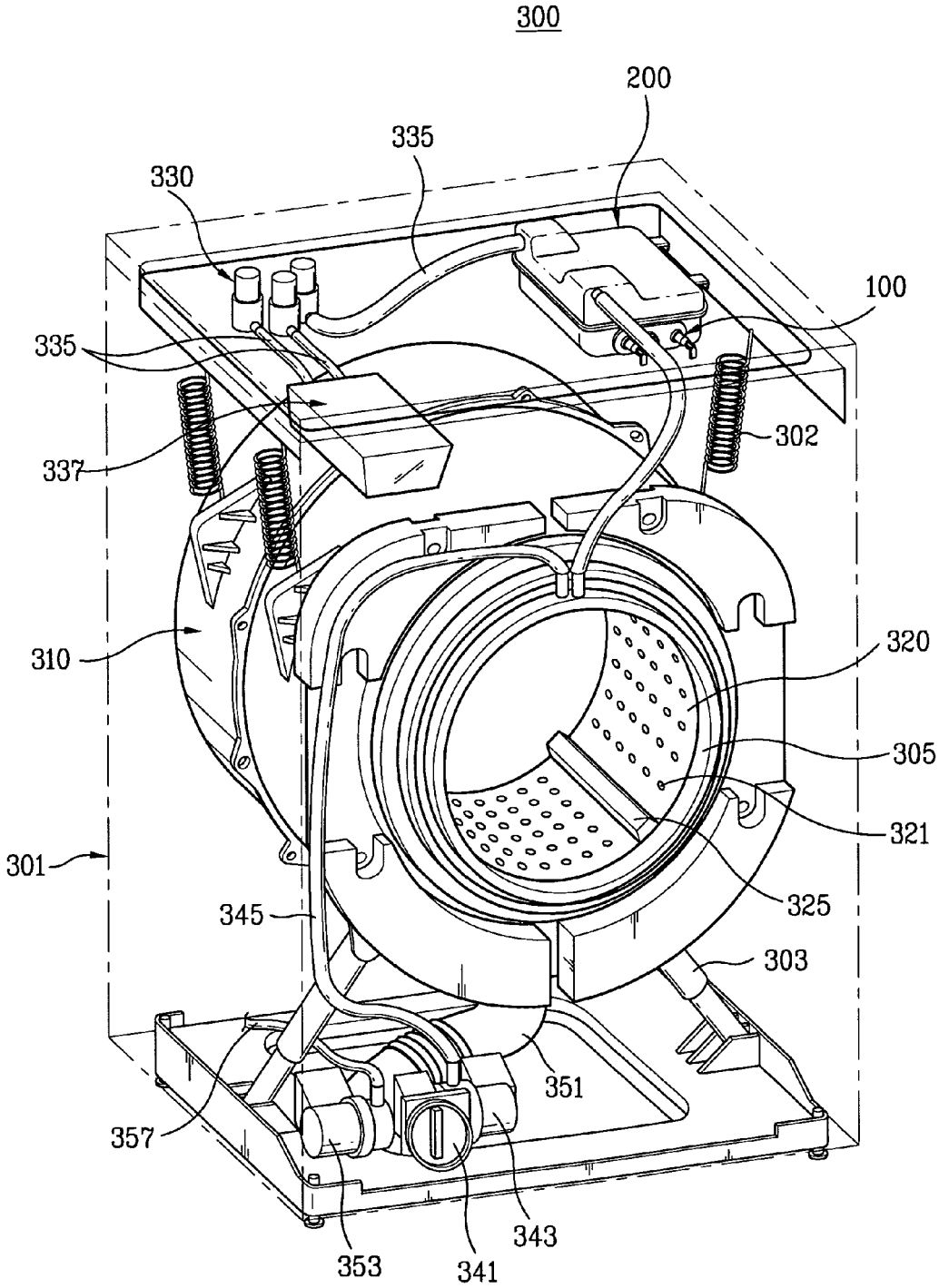
FIG. 9 is perspective view illustrating an embodiment of washing machine with the steam generator shown in FIG. 8 mounted therein.

FIG. 9 is perspective view illustrating a washing machine 300 with the steam generator 200 shown in FIG. 8 mounted therein. The washing machine shown in FIG. 9 is a front-loading type washing machine; however, the steam generator 200 may be also applied to a top-loading type washing machine.

In a cabinet 301 of the washing machine is mounted a tub 310 for receiving water. The tub 310 is supported by the springs 302 and dampers 303 such that the tub 310 is suspended in the cabinet 301. The tub 310 is disposed such that the open front of the tub 310 faces an inlet-hole (not shown) formed in the front of the cabinet 301. In an internal space of the tub 310 is rotatably mounted a drum 320. A motor (not shown) is mounted in the cabinet 301 for rotating the drum 320.

In the circumference of the drum 320 are formed a plurality of through-holes 321, through which the water stored in the tub 310 is introduced into an internal space of the drum 320. A plurality of lifters 325 protrude from the internal circumferential surface of the drum 320. The lifters 325 serve to lift laundry upward and drop the laundry downward when the drum 320 is rotated.

Between the tub 310 and the front of the cabinet 301 is disposed a gasket 305. The gasket 305 serves to prevent the water and the laundry in the tub 310 from being discharged out of the tub 310 and introduced into the internal space of the cabinet 301.

At one side of the cabinet 301 is mounted a water supply valve 330. The water supply valve 330 is connected to an external water source, for example, a water tap, for controlling the supply of water from the water source. Between the tub 310 and the water supply valve 330 are connected at least two water supply hoses 335. One of the water supply hoses 335 is connected to the tub 310 via a detergent box 337, and the other water supply hose 335 is connected to the tub 310 via the steam generator 200.

When detergent is stored in the detergent box 337, water introduced into the detergent box 337 is supplied into the tub 310 together with the detergent. Water introduced into the steam generator 200 is heated by the steam generator 200 such that the water is changed into steam. The steam is supplied into the tub 310. When a washing operation is carried out, the steam is supplied into the tub 310 to improve the washing efficiency. When an operation for sterilizing the laundry or removing smell from the laundry is carried out, the steam is also supplied into the tub 310.

At the bottom of the tub 310 is formed a drain (not shown), to which a drainage bellows 351 is connected. To the drainage bellows 351 is connected a pump unit for pumping out the water introduced from the tub 310 through the drain and the drainage bellows 351 to discharge the water to the outside or circulate the water into the drum 320.

The pump unit includes a pump housing 341, a circulation pump 343, and a drainage pump 353. Water is introduced into the pump housing 341 through the drain and the drainage bellows 351. To the drainage pump 353 is connected a drainage hose 357, which communicates with the outside. The drainage pump 353 serves to discharge the wash water, which is introduced into the pump housing 341 when a draining operation of the washing machine 300 is carried out, to the outside through the drainage hose 357.

To the circulation pump 343 is connected a circulation hose 345. One end of the circulation hose 345 extends through the gasket 305. The circulation pump 343 serves to pump the wash water, which is introduced into the pump housing 341 when a washing and rinsing operation of the washing machine 300 is carried out, to the circulation hose 345. The pumped wash water is injected into the tub 310.

In the above description, the steam generator 200 supplies the steam into the tub 310. However, not steam but hot water may be supplied into the tub through the steam generator 200.

Figure 10:
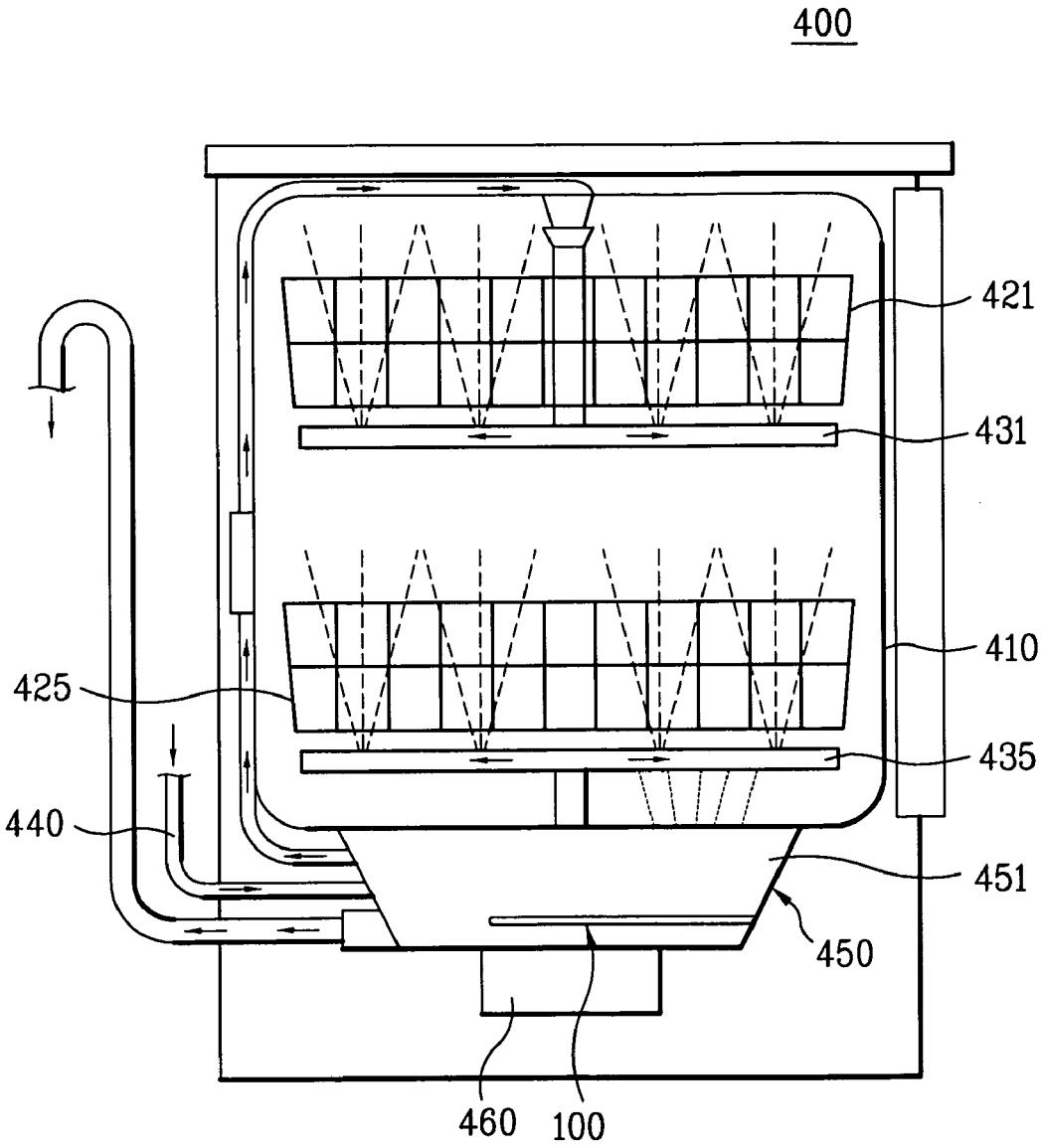
FIG. 10 is a schematic view illustrating an embodiment of dish washing machine with the heating apparatus according to the present invention mounted therein.
Figure 11:
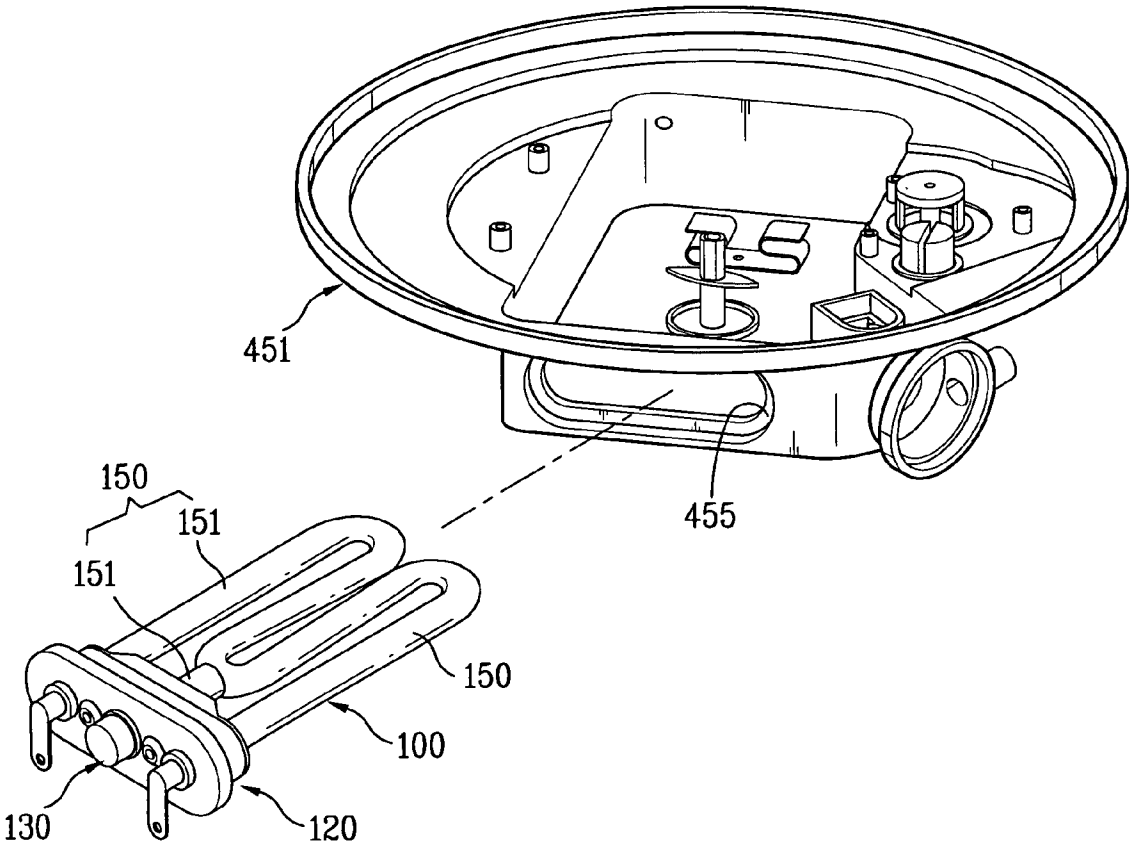
FIG. 11 is an exploded perspective view illustrating the coupling between the heating apparatus, which heats water, and a sump, which stores water, in the dish washing machine shown in FIG. 10.

FIGS. 10 and 11 illustrate an embodiment of dish washing machine 400 with the heating apparatus 100 according to the present invention mounted therein. Hereinafter, the structure of the dish washing machine will be described in brief with reference to these drawings.

The dish washing machine 400 is constructed in a structure in which at least one rack, on which dishes are placed, is mounted in a tub 410, and at least one injection arm for injecting wash water to the dishes is mounted adjacent to the at least one rack. For reference, FIG. 10 illustrates an example in which two racks, i.e., an upper rack 421 and a lower rack 425, are mounted in the tub 410, and two injection arms, i.e., an upper arm 431 and a lower arm 435, are mounted below the upper rack 421 and the lower rack 425, respectively.

Below the tub 410 is mounted a wash water supply unit 450. The wash water supply unit 450 serves to supply wash water to the injection arms, i.e., the upper arm 431 and the lower arm 435. In addition, the wash water supply unit 450 serves to filter the wash water used to wash the dishes and resupply the filtered wash water to the upper arm 431 and the lower arm 435.

The wash water supply unit 450 is provided with a sump 451. The sump 451, which serves to store wash water, is mounted below the tub 410 to form the bottom of the tub 410. Consequently, water supplied into the tub 410 or water injected to wash the dishes in the tub 410 is stored in the sump 451.

At the inside bottom of the tub 410, i.e., inside the sump 451, the heating apparatus 100 for heating water stored in the sump 451, as shown in FIG. 10. The heating apparatus 100 is mounted in the sump 451 through an opening 455 formed in one side of the sump 451, as shown in FIG. 11.

The structure of the heating apparatus and the process of mounting the heating apparatus were described above in detail, and therefore, detailed descriptions thereof will not be given. The dish washing machine 400 uses hot water heated by the heating apparatus to cleanly wash and sterilize the dishes.

To the tub 410 is connected a water supply hose 440, through which water is supplied. The water supply hose 440 may be connected to the side of the tub 410, or, as shown in FIG. 10, to the sump 451. To the sump 451 is connected a wash water supply pump 460. The wash water supply pump 460 pumps wash water stored at the bottom of the tub 410, i.e., the sump 451, to supply the injection arms, i.e., the upper arm 431 and the lower arm 435. The wash water is injected to the dishes through the upper arm 431 and the lower arm 435 such that the dishes are washed by the injected water.

Although not shown, the heating apparatus 100 according to the present invention may be directly connected to the tub of the washing machine to heat water stored in the tub in a different fashion from the example shown in FIG. 9. This structure is similar to what was described with reference to FIGS. 10 and 11. Although not shown, on the other hand, the steam generator 200 according to the present invention may be applied to the dish washing machine 400. For example, when the steam generator 200 is connected to the tub 410, the steam generator 200 may be appropriately used to sterilize the dishes placed in the tub 410.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As apparent from the above description, the present invention is applicable to a heating apparatus and a steam generator which is capable of heating water to produce hot water or steam. Also, the present invention is applicable to an electric home appliance, such as a washing machine or a dish washing machine, which is capable of capable of washing, rinsing, drying, or sterilizing an object using the heating apparatus and the steam generator.

In the heating apparatus and the steam generator, the heat transfer member accurately measures the temperature of the heating member and transmits the measured temperature of the heating member to the thermostat. Consequently, the present invention has the effect of effectively preventing the heating member from overheating.

According to the present invention, the heating member, the fixing unit assembly, the thermostat, and the heat transfer member is provided as one united body. The united body is detachably mounted to a support structure, for example, a heating apparatus, a steam generator, or an electric home appliance using the same. Consequently, the present invention has the effect of improving the assembly efficiency and productivity of products and accomplishing easy repair of products which are out of order.

The invention claimed is:

1. A heating apparatus comprising:

a heating member;

a fixing unit assembly for fixing the heating member to a predetermined support structure;

a thermostat mounted to the fixing unit assembly for preventing the heating member from overheating; and a heat transfer member connected between the heating member and the thermostat for transferring heat from the heating member to the thermostat, wherein the heat transfer member includes a metal layer formed to cover the outer circumferential surface of a heat emission part of the heating member, a portion of the metal layer extending toward the thermostat, and wherein the heat transfer member further includes an auxiliary member interposed between the metal layer and the thermostat for indirectly transferring heat from the heat emission part to the thermostat.

2. The heating apparatus according to claim 1, wherein the heating member, the fixing unit assembly, the thermostat, and the heat transfer member are detachably mounted to the support structure at the same time.

3. The heating apparatus according to claim 1, wherein the metal layer is formed by die casting, and the metal layer securely fixes the heating member to the fixing unit assembly.

4. A steam generator comprising:

a case having an opening, through which an internal space of the case communicates with the outside, formed in one side thereof;

a heating member extending through the opening for generating steam;

a fixing unit assembly for fixing the heating member to the case while sealing the opening;

a thermostat mounted to the fixing unit assembly for preventing the heating member from overheating; and a heat transfer member for increasing a heat emission area of the heating member and transferring heat from the heating member to the thermostat, wherein the heat transfer member includes a metal layer formed to cover the outer circumferential surface of a heat emission part of the heating member, a portion of the metal layer extending toward the thermostat, and wherein the heat transfer member further includes an auxiliary member interposed between the metal layer and the thermostat for indirectly transferring heat from the heat emission part to the thermostat.

5. The steam generator according to claim 4, wherein the heating member, the fixing unit assembly, the thermostat, and the heat transfer member are detachably mounted to the case at the same time.

6. The steam generator according to claim 4, wherein the fixing unit assembly includes a packing fitted in the opening such that the heating member extends through the packing, and a pressurizing unit for pressurizing the packing to expand the side of the packing such that the heating member is fixed to the case while the opening is sealed.

7. The steam generator according to claim 4, wherein the fixing unit assembly includes an inner bracket and an outer bracket disposed at the inside and the outside of the case, respectively, a packing fitted in the opening, the packing being interposed between the inner bracket and the outer bracket, and fasteners coupled to the inner bracket and the outer bracket such that the fasteners can be tightened or loosened from the outside of the case for changing the distance between the inner bracket and the outer bracket.

8. The steam generator according to claim 6 or 7, wherein the heating member and the fixing unit assembly have a size sufficient to be withdrawn out of the case through the opening while the packing is not deformed.

9. The steam generator according to claim 4, wherein the metal layer is formed by die casting, and the metal layer securely fixes the heating member to the fixing unit assembly.

10. The steam generator according to claim 7, wherein the auxiliary member extending through the inner bracket and the packing for transferring heat from the metal layer to the thermostat.

11. An electric home appliance comprising:

a tub for storing water; and a heating apparatus connected to the tub for heating the water, wherein the heating apparatus includes a heating member extending through the tub, a fixing unit assembly for fixing the heating member to the tub while sealing the connection between the heating member and the tub, a thermostat mounted to the fixing unit assembly for preventing the heating member from overheating, and a heat transfer member for increasing a heat emission area of the heating member and transferring heat from the heating member to the thermostat, wherein the heat transfer member includes a metal layer formed to cover the outer circumferential surface of a heat emission part of the heating member, a portion of the metal layer extending toward the thermostat, and wherein the heat transfer member further includes an auxiliary member interposed between the metal layer and the thermostat for indirectly transferring heat from the heat emission part to the thermostat.

12. The electric home appliance according to claim 11, wherein the heating member, the fixing unit assembly, the thermostat, and the heat transfer member are detachably mounted to the tub at the same time.

13. An electric home appliance comprising:

a tub for receiving an object;

a water supply hose connected between an external water source and the tub; and a heating apparatus mounted at the middle of the water supply hose for heating the water, wherein the heating apparatus includes a case mounted at the middle of the water supply hose, the case having an opening formed in one side thereof, a heating member extending through the opening, a fixing unit assembly for fixing the heating member to the case while sealing the opening, a thermostat mounted to the fixing unit assembly for preventing the heating member from overheating, and a heat transfer member for increasing a heat emission area of the heating member and transferring heat from the heating member to the thermostat, wherein the heat transfer member includes a metal layer formed to cover the outer circumferential surface of a heat emission part of the heating member, a portion of the metal layer extending toward the thermostat, and wherein the heat transfer member further includes an auxiliary member interposed between the metal layer and the thermostat for indirectly transferring heat from the heat emission part to the thermostat.

14. The electric home appliance according to claim 13, wherein the heating member, the fixing unit assembly, the thermostat, and the heat transfer member are detachably mounted to the case at the same time.

15. The electric home appliance according to claim 11 or 13, wherein the metal layer is formed by die casting, the metal layer securely fixing the heating member to the fixing unit assembly.

16. A heating apparatus comprising:

a heating member bent several times;

a fixing unit assembly for fixing the heating member to a predetermined support structure;

a thermostat mounted to the fixing unit assembly for preventing the heating member from overheating; and a heat transfer member connected between the heating member and the thermostat for transferring heat from the heating member to the thermostat wherein the heat transfer member includes a metal layer formed to cover the outer circumferential surface of a heat emission part of the heating member, and wherein a portion of the metal layer covering the bent part of the heating member are extended toward the thermostat so that the portion of the metal layer directly connects the thermostat.

17. The heating apparatus according to claim 16, wherein the metal layer is formed by die casting, and the metal layer securely fixes the heating member to the fixing unit assembly.

18. The heating apparatus according to claim 16, wherein the heating member, the fixing unit assembly, the thermostat, and the heat transfer member are detachably mounted to the support structure at the same time.

19. A heating apparatus comprising:

a heating member;

a fixing unit assembly for fixing the heating member to a predetermined support structure;

a thermostat mounted to the fixing unit assembly for preventing the heating member from overheating; and a heat transfer member connected between the heating member and the thermostat for transferring heat from the heating member to the thermostat, wherein the heat transfer member includes a metal layer formed to cover the outer circumferential surface of a heat emission part of the heating member, wherein the fixing unit assembly includes an inner bracket and an outer bracket disposed at the inside and the outside of the case respectively, and a packing fitted in the opening, the packing being interposed between the inner bracket and the outer bracket, wherein, the heat transfer member includes a metal layer formed to cover the outer circumferential surface of a heat emission part of the heating member, and wherein, the thermostat extends through the packing and the inner bracket so that thermostat is connected to the metal layer.

20. The heating apparatus according to claim 19, wherein the metal layer is formed by die casting, and the metal layer securely fixes the heating member to the fixing unit assembly.

* * * * *